US010311824B2

(12) United States Patent
Richards et al.

(10) Patent No.: US 10,311,824 B2
(45) Date of Patent: Jun. 4, 2019

(54) MULTIPLE DRIVER IC BACK LIGHT UNIT AND LIQUID CRYSTAL RESPONSE TIMING FOR LCD FOR VIRTUAL REALITY

(71) Applicant: Facebook Technologies, LLC, Menlo Park, CA (US)

(72) Inventors: Evan M. Richards, Santa Clara, CA (US); Nirav Rajendra Patel, San Francisco, CA (US)

(73) Assignee: Facebook Technologies, LLC, Menlo Park, CA (US)

( * ) Notice: Subject to any disclaimer, the term of this patent is extended or adjusted under 35 U.S.C. 154(b) by 72 days.

(21) Appl. No.: 15/492,516

(22) Filed: Apr. 20, 2017

(65) Prior Publication Data

US 2017/0309245 A1 Oct. 26, 2017

Related U.S. Application Data

(60) Provisional application No. 62/326,442, filed on Apr. 22, 2016.

(51) Int. Cl.

| | |
|---|---|
| ***G09G 3/36*** | (2006.01) |
| ***G09G 3/34*** | (2006.01) |
| ***G09G 3/00*** | (2006.01) |

(52) U.S. Cl.

CPC ..... *G09G 3/3688* (2013.01); *G09G 3/001* (2013.01); *G09G 3/3406* (2013.01); *G09G 3/3611* (2013.01); *G09G 2310/0237* (2013.01)

(58) Field of Classification Search

CPC ..... G09G 3/34–3696

See application file for complete search history.

(56) References Cited

U.S. PATENT DOCUMENTS

| | | | | |
|---|---|---|---|---|
| 2003/0058229 | A1* | 3/2003 | Kawabe | G09G 3/342 345/204 |
| 2007/0091059 | A1* | 4/2007 | Kang | G09G 3/342 345/102 |
| 2007/0103425 | A1* | 5/2007 | Tanaka | G09G 3/3648 345/102 |
| 2007/0132709 | A1 | 6/2007 | Kawaguchi | |
| 2009/0267877 | A1* | 10/2009 | Yen | G09G 3/006 345/87 |

* cited by examiner

*Primary Examiner* — Sanghyuk Park

(74) *Attorney, Agent, or Firm* — Fenwick & West LLP

(57) ABSTRACT

A display device that includes a liquid crystal (LC) panel, a back light unit (BLU), a first data driver, and a second data driver. The back light unit (BLU) emits light during an illumination portion of a frame period and does not emit light during a remaining portion of the frame period. A first data driver writes data to a first portion of the pixels of the LC panel. A second data driver writes data to a second portion of the pixels of the LC panel. The first and second data drivers write data at an overlapping time during a write portion of the frame period. The write portion overlaps in time with the remaining portion of the frame period during which the BLU does not emit light.

15 Claims, 5 Drawing Sheets

MULTIPLE DRIVER IC BACK LIGHT UNIT AND LIQUID CRYSTAL RESPONSE TIMING FOR LCD FOR VIRTUAL REALITY

CROSS-REFERENCE TO RELATED APPLICATION

This application claims the priority benefit of U.S. Provisional Patent Application No. 62/326,442 filed on Apr. 22, 2016 which is incorporated herein by reference for all purposes as if fully set forth herein.

BACKGROUND

The present disclosure generally relates to enhancing a Liquid Crystal Display (LCD) for use in a virtual reality, mixed reality, or augmented reality system.

SUMMARY

A display device that includes a liquid crystal (LC) panel, a back light unit (BLU), a first data driver, and a second data driver. The LC panel includes a plurality of rows of pixels in a pixel area including a first row and a last row. The back light unit (BLU) emits light during an illumination portion of a frame period and does not emit light during a remaining portion of the frame period. A first data driver writes data to a first portion of the pixels of the LC panel. A second data driver writes data to a second portion of the pixels of the LC panel. The first and second data drivers write data at an overlapping time during a write portion of the frame period. The write portion overlaps in time with the remaining portion of the frame period during which the BLU does not emit light.

Also described is a method of displaying an image by a display device, the method including steps of emitting, by a back light unit (BLU), light during an illumination portion of a frame period and not emitting light during a remaining portion of the frame period; writing, by a first data driver, data to a first portion of pixels of a liquid crystal (LC) panel; writing, by a second data driver, data to a second portion of the pixels of the LC panel, wherein the first and second data drivers write data at an overlapping time during a write portion of the frame period, the write portion overlapping in time with the remaining portion of the frame period during which the BLU does not emit light.

In one embodiment, the first data driver and the second data driver write data during the write portion of the frame period such that liquid crystal material in all rows of the pixels complete transition before the illumination portion of the frame period. In one aspect, the frame period may be 11 milliseconds in length, the write portion may be 3 milliseconds in length, and the illumination portion may be 2 milliseconds in length.

In another embodiment, the write portion occurs during an entire frame period.

In an embodiment, liquid crystal material in one or more rows of the pixels transitions during the illumination portion of the frame period. The liquid crystal material in the last row of the pixels may complete transition after an end of the write portion of the frame period and before an end of the frame period. The liquid crystal material in the first row of the pixels may complete transition after the end of the write portion of the frame period and before the end of the frame period. In one aspect, the frame period may be 11 milliseconds, the write period may be 5 milliseconds, and the illumination period may be 2 milliseconds.

In one embodiment, the first data driver and the second data driver are located on a same side of the pixel area. The first and the second data driver may write data to the LC panel from the first row to the last row of the pixels. In one aspect, the LC panel includes a plurality of columns of the pixels and the first portion of the pixels are in a first half of the columns and the second portion of the pixels are in a second half of the columns. The first half of the columns may be even columns and the second half of the pixel columns may be odd columns.

In another embodiment, the first data driver and the second data driver are located on opposite sides of the pixel area. In one aspect, the first portion of the pixels include a top half of rows of the pixels in a top half of the pixel area and the second portion of the pixels include a bottom half of rows of the pixels in a bottom half of the pixel area. The first data driver may write data from a bottom row of the top half of the rows to the first row of the LC panel and the second data driver may write data from a top row of the bottom half of the rows to the last row of the LC panel.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

System Overview

Figure 1:
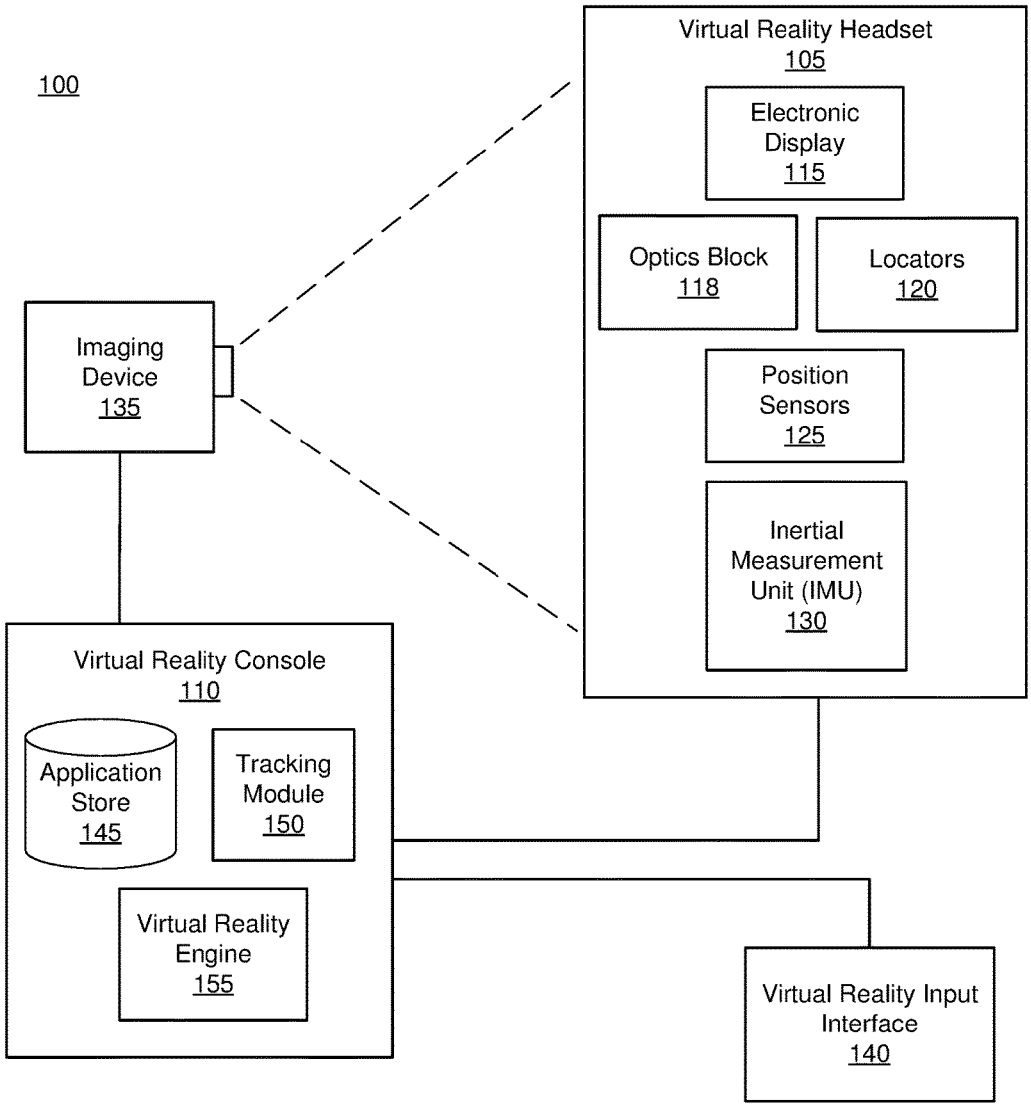
FIG. 1 is a block diagram of a system environment including a virtual reality system, in accordance with an embodiment.

FIG. 1 is a block diagram of a virtual reality (VR) system environment 100 in which a VR console 110 operates. The system environment 100 shown by FIG. 1 comprises a VR headset 105, an imaging device 135, and a VR input interface 140 that are each coupled to the VR console 110. While FIG. 1 shows an example system 100 including one VR headset 105, one imaging device 135, and one VR input interface 140, in other embodiments any number of these components may be included in the system 100. For example, there may be multiple VR headsets 105 each having an associated VR input interface 140 and being monitored by one or more imaging devices 135, with each VR headset 105, VR input interface 140, and imaging devices 135 communicating with the VR console 110. In alternative configurations, different and/or additional components may be included in the system environment 100.

The VR headset 105 is a head-mounted display that presents media to a user. Examples of media presented by the VR head set include one or more images, video, audio, or some combination thereof. In some embodiments, audio is presented via an external device (e.g., speakers and/or headphones) that receives audio information from the VR headset 105, the VR console 110, or both, and presents audio data based on the audio information. An embodiment of the VR headset 105 is further described below in conjunction with FIGS. 2A and 2B. The VR headset 105 may comprise one or more rigid bodies, which may be rigidly or non-rigidly coupled to each other together. A rigid coupling between rigid bodies causes the coupled rigid bodies to act as a single rigid entity. In contrast, a non-rigid coupling between rigid bodies allows the rigid bodies to move relative to each other.

The VR headset 105 includes an electronic display 115, an optics block 118, one or more locators 120, one or more position sensors 125, and an inertial measurement unit (IMU) 130. The electronic display 115 displays images to the user in accordance with data received from the VR console 110. In various embodiments, the electronic display 115 may comprise a single electronic display or multiple electronic displays (e.g., an electronic display for each eye of a user).

An electronic display 115 may be a liquid crystal display (LCD), an organic light emitting diode (OLED) display, an active-matrix organic light-emitting diode display (AMOLED), a TOLED, some other display, or some combination thereof.

The optics block 118 magnifies received light from the electronic display 115, corrects optical errors associated with the image light, and the corrected image light is presented to a user of the VR headset 105. An optical element may be an aperture, a Fresnel lens, a convex lens, a concave lens, a filter, or any other suitable optical element that affects the image light emitted from the electronic display 115. Moreover, the optics block 118 may include combinations of different optical elements. In some embodiments, one or more of the optical elements in the optics block 118 may have one or more coatings, such as anti-reflective coatings.

Magnification of the image light by the optics block 118 allows the electronic display 115 to be physically smaller, weigh less, and consume less power than larger displays. Additionally, magnification may increase a field of view of the displayed media. For example, the field of view of the displayed media is such that the displayed media is presented using almost all (e.g., 110 degrees diagonal), and in some cases all, of the user's field of view. In some embodiments, the optics block 118 is designed so its effective focal length is larger than the spacing to the electronic display 115, which magnifies the image light projected by the electronic display 115. Additionally, in some embodiments, the amount of magnification may be adjusted by adding or removing optical elements.

The optics block 118 may be designed to correct one or more types of optical error. Examples of optical error include: two dimensional optical errors, three dimensional optical errors, or some combination thereof. Two dimensional errors are optical aberrations that occur in two dimensions. Example types of two dimensional errors include: barrel distortion, pincushion distortion, longitudinal chromatic aberration, transverse chromatic aberration, or any other type of two-dimensional optical error. Three dimensional errors are optical errors that occur in three dimensions. Example types of three dimensional errors include spherical aberration, comatic aberration, field curvature, astigmatism, or any other type of three-dimensional optical error. In some embodiments, content provided to the electronic display 115 for display is pre-distorted, and the optics block 118 corrects the distortion when it receives image light from the electronic display 115 generated based on the content.

The locators 120 are objects located in specific positions on the VR headset 105 relative to one another and relative to a specific reference point on the VR headset 105. A locator 120 may be a light emitting diode (LED), a corner cube reflector, a reflective marker, a type of light source that contrasts with an environment in which the VR headset 105 operates, or some combination thereof. In embodiments where the locators 120 are active (i.e., an LED or other type of light emitting device), the locators 120 may emit light in the visible band (~380 nm to 750 nm), in the infrared (IR) band (~750 nm to 1 mm), in the ultraviolet band (10 nm to 380 nm), some other portion of the electromagnetic spectrum, or some combination thereof.

In some embodiments, the locators 120 are located beneath an outer surface of the VR headset 105, which is transparent to the wavelengths of light emitted or reflected by the locators 120 or is thin enough not to substantially attenuate the wavelengths of light emitted or reflected by the locators 120. Additionally, in some embodiments, the outer surface or other portions of the VR headset 105 are opaque in the visible band of wavelengths of light. Thus, the locators 120 may emit light in the IR band under an outer surface that is transparent in the IR band but opaque in the visible band.

The IMU 130 is an electronic device that generates fast calibration data based on measurement signals received from one or more of the position sensors 125. A position sensor 125 generates one or more measurement signals in response to motion of the VR headset 105. Examples of position sensors 125 include: one or more accelerometers, one or more gyroscopes, one or more magnetometers, another suitable type of sensor that detects motion, a type of sensor used for error correction of the IMU 130, or some combination thereof. The position sensors 125 may be located external to the IMU 130, internal to the IMU 130, or some combination thereof.

Based on the one or more measurement signals from one or more position sensors 125, the IMU 130 generates fast calibration data indicating an estimated position of the VR headset 105 relative to an initial position of the VR headset 105. For example, the position sensors 125 include multiple accelerometers to measure translational motion (forward/back, up/down, left/right) and multiple gyroscopes to measure rotational motion (e.g., pitch, yaw, roll). In some embodiments, the IMU 130 rapidly samples the measurement signals and calculates the estimated position of the VR headset 105 from the sampled data. For example, the IMU 130 integrates the measurement signals received from the accelerometers over time to estimate a velocity vector and integrates the velocity vector over time to determine an estimated position of a reference point on the VR headset 105. Alternatively, the IMU 130 provides the sampled measurement signals to the VR console 110, which determines the fast calibration data. The reference point is a point that may be used to describe the position of the VR headset 105. While the reference point may generally be defined as a point in space; however, in practice the reference point is defined as a point within the VR headset 105 (e.g., a center of the IMU 130).

The IMU 130 receives one or more calibration parameters from the VR console 110. As further discussed below, the one or more calibration parameters are used to maintain tracking of the VR headset 105. Based on a received calibration parameter, the IMU 130 may adjust one or more IMU parameters (e.g., sample rate). In some embodiments, certain calibration parameters cause the IMU 130 to update an initial position of the reference point so it corresponds to a next calibrated position of the reference point. Updating the initial position of the reference point as the next calibrated position of the reference point helps reduce accumulated error associated with the determined estimated position. The accumulated error, also referred to as drift error, causes the estimated position of the reference point to "drift" away from the actual position of the reference point over time.

The imaging device 135 generates slow calibration data in accordance with calibration parameters received from the VR console 110. Slow calibration data includes one or more images showing observed positions of the locators 120 that are detectable by the imaging device 135. The imaging device 135 may include one or more cameras, one or more video cameras, any other device capable of capturing images including one or more of the locators 120, or some combination thereof. Additionally, the imaging device 135 may include one or more filters (e.g., used to increase signal to noise ratio). The imaging device 135 is configured to detect light emitted or reflected from locators 120 in a field of view of the imaging device 135. In embodiments where the locators 120 include passive elements (e.g., a retroreflector), the imaging device 135 may include a light source that illuminates some or all of the locators 120, which retroreflect the light towards the light source in the imaging device 135. Slow calibration data is communicated from the imaging device 135 to the VR console 110, and the imaging device 135 receives one or more calibration parameters from the VR console 110 to adjust one or more imaging parameters (e.g., focal length, focus, frame rate, ISO, sensor temperature, shutter speed, aperture, etc.).

The VR input interface 140 is a device that allows a user to send action requests to the VR console 110. An action request is a request to perform a particular action. For example, an action request may be to start or end an application or to perform a particular action within the application. The VR input interface 140 may include one or more input devices. Example input devices include: a keyboard, a mouse, a game controller, or any other suitable device for receiving action requests and communicating the received action requests to the VR console 110. An action request received by the VR input interface 140 is communicated to the VR console 110, which performs an action corresponding to the action request. In some embodiments, the VR input interface 140 may provide haptic feedback to the user in accordance with instructions received from the VR console 110. For example, haptic feedback is provided when an action request is received, or the VR console 110 communicates instructions to the VR input interface 140 causing the VR input interface 140 to generate haptic feedback when the VR console 110 performs an action.

The VR console 110 provides media to the VR headset 105 for presentation to the user in accordance with information received from one or more of: the imaging device 135, the VR headset 105, and the VR input interface 140. In the example shown in FIG. 1, the VR console 110 includes an application store 145, a tracking module 150, and a virtual reality (VR) engine 155. Some embodiments of the VR console 110 have different modules than those described in conjunction with FIG. 1. Similarly, the functions further described below may be distributed among components of the VR console 110 in a different manner than is described here.

The application store 145 stores one or more applications for execution by the VR console 110. An application is a group of instructions, that when executed by a processor, generates content for presentation to the user. Content generated by an application may be in response to inputs received from the user via movement of the HR headset 105 or the VR interface device 140. Examples of applications include: gaming applications, conferencing applications, video playback application, or other suitable applications.

The tracking module 150 calibrates the VR system 100 using one or more calibration parameters and may adjust one or more calibration parameters to reduce error in determination of the position of the VR headset 105. For example, the tracking module 150 adjusts the focus of the imaging device 135 to obtain a more accurate position for observed locators on the VR headset 105. Moreover, calibration performed by the tracking module 150 also accounts for information received from the IMU 130. Additionally, if tracking of the VR headset 105 is lost (e.g., the imaging device 135 loses line of sight of at least a threshold number of the locators 120), the tracking module 140 re-calibrates some or all of the system environment 100.

The tracking module 150 tracks movements of the VR headset 105 using slow calibration information from the imaging device 135. The tracking module 150 determines positions of a reference point of the VR headset 105 using observed locators from the slow calibration information and a model of the VR headset 105. The tracking module 150 also determines positions of a reference point of the VR headset 105 using position information from the fast calibration information. Additionally, in some embodiments, the tracking module 150 may use portions of the fast calibration information, the slow calibration information, or some combination thereof, to predict a future location of the headset 105. The tracking module 150 provides the estimated or predicted future position of the VR headset 105 to the VR engine 155.

The VR engine 155 executes applications within the system environment 100 and receives position information, acceleration information, velocity information, predicted future positions, or some combination thereof of the VR headset 105 from the tracking module 150. Based on the received information, the VR engine 155 determines content to provide to the VR headset 105 for presentation to the user. For example, if the received information indicates that the user has looked to the left, the VR engine 155 generates content for the VR headset 105 that mirrors the user's movement in a virtual environment. Additionally, the VR engine 155 performs an action within an application executing on the VR console 110 in response to an action request received from the VR input interface 140 and provides feedback to the user that the action was performed. The provided feedback may be visual or audible feedback via the VR headset 105 or haptic feedback via the VR input interface 140.

Figure 2A:
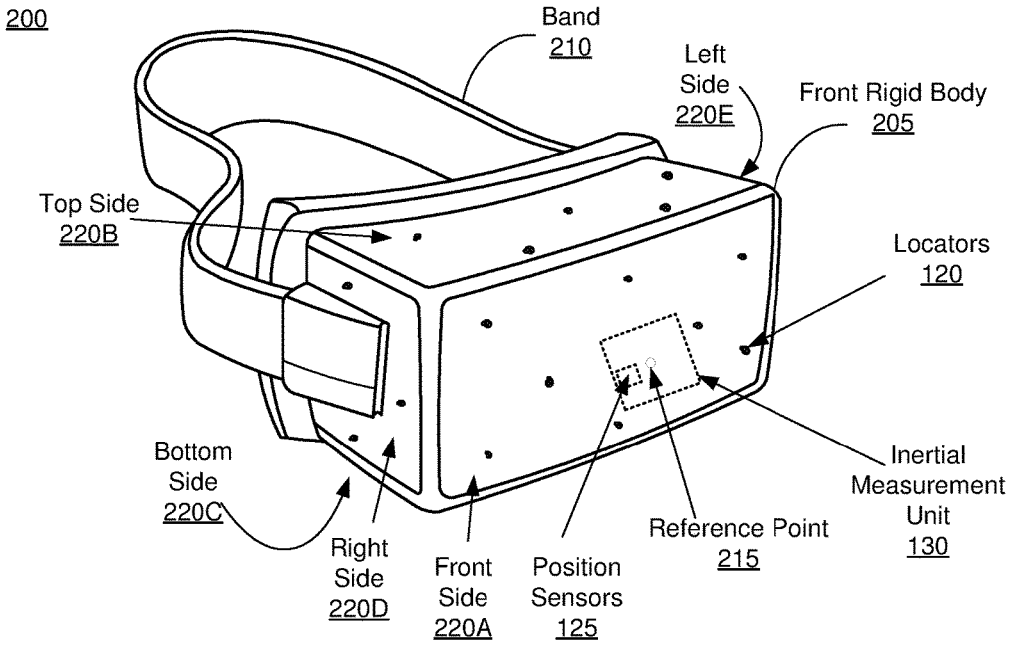
FIG. 2A is a diagram of a virtual reality headset, in accordance with an embodiment.

FIG. 2A is a diagram of a virtual reality (VR) headset, in accordance with an embodiment. The VR headset 200 is an embodiment of the VR headset 105, and includes a front rigid body 205 and a band 210. The front rigid body 205 includes an electronic display 115, the IMU 130, the one or more position sensors 125, and the locators 120. In the embodiment shown by FIG. 2A, the position sensors 125 are located within the IMU 130, and neither the IMU 130 nor the position sensors 125 are visible to the user.

The locators 120 are located in fixed positions on the front rigid body 205 relative to one another and relative to a reference point 215. In the example of FIG. 2A, the reference point 215 is located at the center of the IMU 130. Each of the locators 120 emit light that is detectable by the imaging device 135. Locators 120, or portions of locators 120, are located on a front side 220A, a top side 220B, a bottom side 220C, a right side 220D, and a left side 220E of the front rigid body 205 in the example of FIG. 2A.

Figure 2B:
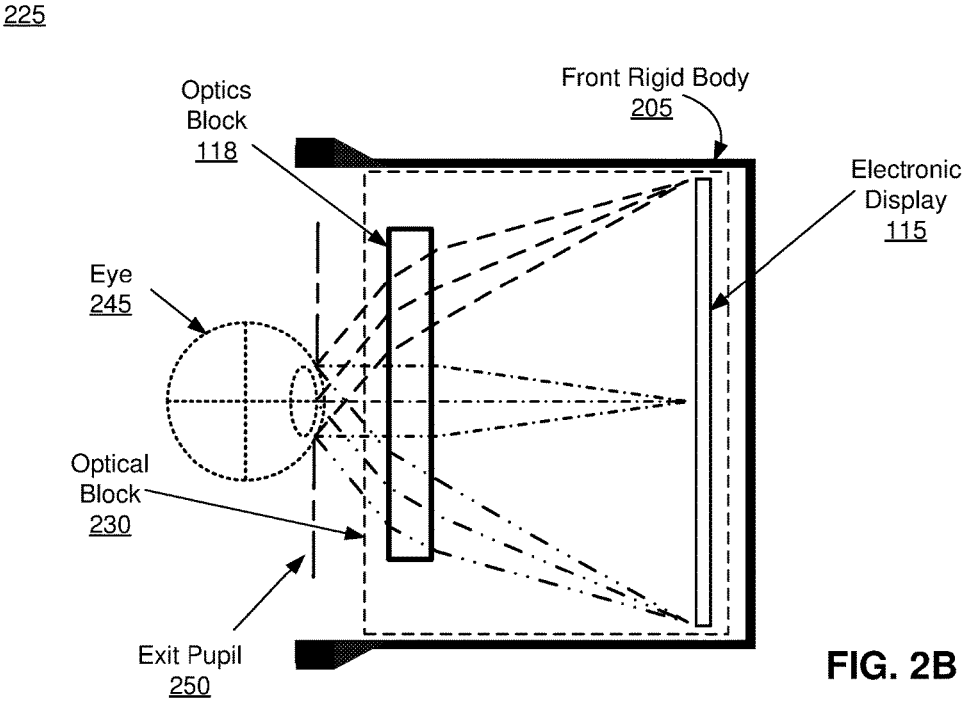
FIG. 2B is a cross section of a front rigid body of the VR headset in FIG. 2A, in accordance with an embodiment.

FIG. 2B is a cross section 225 of the front rigid body 205 of the embodiment of a VR headset 200 shown in FIG. 2A. As shown in FIG. 2B, the front rigid body 205 includes an optical block 230 that provides altered image light to an exit pupil 250. The exit pupil 250 is the location of the front rigid body 205 where a user's eye 245 is positioned. For purposes of illustration, FIG. 2B shows a cross section 225 associated with a single eye 245, but another optical block, separate from the optical block 230, provides altered image light to another eye of the user.

The optical block 230 includes an electronic display 115, and the optics block 118. The electronic display 115 emits image light toward the optics block 118. The optics block 118 magnifies the image light, and in some embodiments, also corrects for one or more additional optical errors (e.g., distortion, astigmatism, etc.). The optics block 118 directs the image light to the exit pupil 250 for presentation to the user.

Figure 3A:
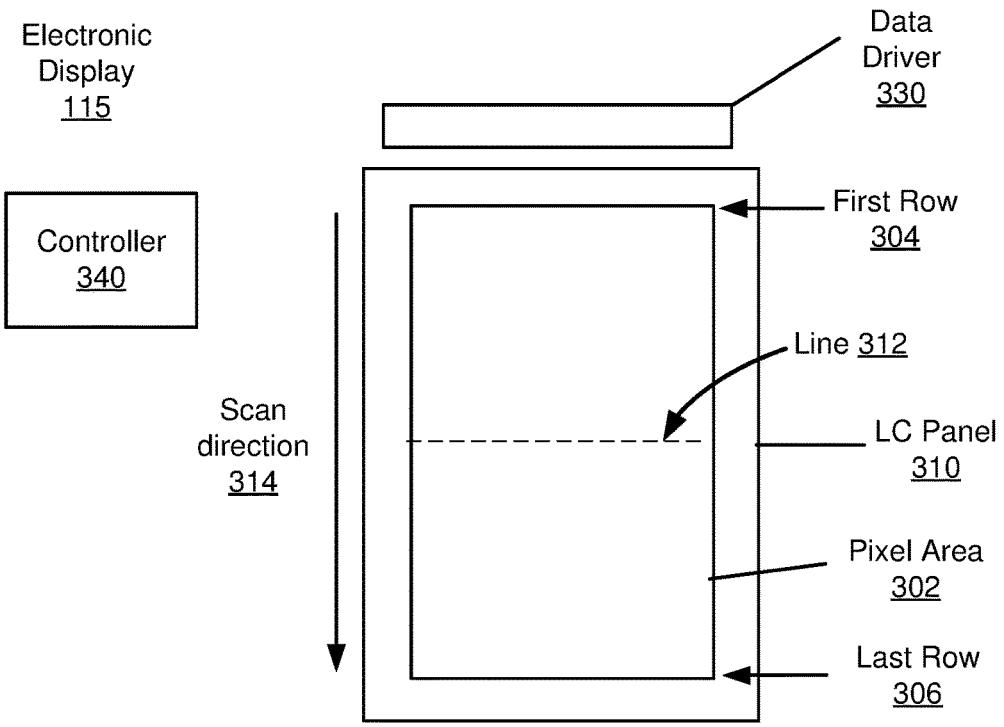
FIG. 3A is a top view of an example electronic display, in accordance with an embodiment.
Figure 3B:
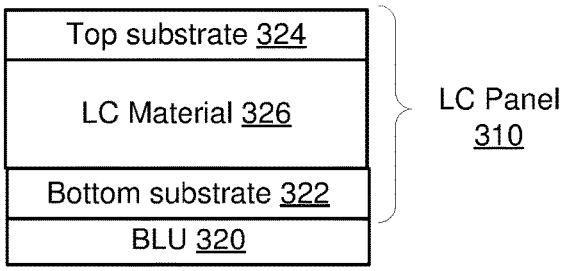
FIG. 3B is a cross section of an example electronic display, in accordance with an embodiment.

FIG. 3A is a top view and FIG. 3B is a cross section of an electronic display 115, in accordance with an embodiment. In one embodiment, the electronic display 115 is a LCD device including a LC panel 310, BLU 320, a data driver 330, and a controller 340. The LC panel 310 covers the BLU 320 and includes a pixel area 302 comprising a plurality of rows of pixels including a first row 304 and a last row 306 of pixels. A cross section of the pixel area 302 along line 312 is shown in FIG. 3B and shows the LC panel 310 covering the BLU 320.

The BLU 320 includes a light source (not shown) that is an electrical component that generates light. The light source may comprise a plurality of light emitting components (e.g., light emitting diodes (LEDs), light bulbs, or other components for emitting light). In one aspect, intensity of light from the light source is adjusted according to a backlight control signal from the controller 340. The backlight control signal is a signal indicative of intensity of light to be output for the light source. A light source may adjust its duty cycle of or an amount of current supplied to the light emitting component (e.g., LED), according to the backlight control signal. For example, the light source may be 'ON' for a portion of a frame time, and 'OFF' for another portion of the frame time, according to the backlight control signal. Example operations of the BLU 320 are further described in detail below with respect to FIGS. 4A to 4E. The BLU 320 projects light from the light source towards the LC panel 310. The BLU 320 may include a light guide plate and refractive and/or reflective components for projecting light towards the LC panel 310. The light guide plate may receive light with different colors from light sources, and may project combined light including a combination of the different colors towards the LC panel 310.

The LC panel 310 includes a bottom substrate 322, a top substrate 324, and LC material 326 between the bottom and top substrates 322 and 324. Although not shown in FIG. 3B, the bottom substrate 322 may include driver pixel circuitry and transparent pixel electrodes, and the top substrate 324 may include color filters, a black matrix, and transparent conductive electrodes. Also, spacers may be used to control the spacing between the top substrate and the bottom substrate, although not shown in FIG. 3B. The LC material 326 is placed between the top and bottom substrate 322 and 324.

The data driver 330 is coupled to the LC panel 310 and writes display data to pixels in the pixel area 302 of the LC panel 310. Although shown as a separate component, the data driver 330 may be included in the LC panel 310. The data driver 330 writes the display data in a scan direction 314 from a first row 304 to a last row 306 of pixels in the pixel area 302. The display data written to a pixel may be in the form of an analog voltage that may be applied across electrodes on the bottom and/or top substrate 322 and 324 of a pixel to change the orientation of LC material 326 in the LC panel 310. The change in orientation of the LC material 326 allows a portion of the light from the BLU 320 to reach a user's eye 245.

The controller 340 is a circuit component that receives an input image data and generates control signals for driving the data driver 330 and BLU 320. The input image data may correspond to an image or a frame of a video in a VR and/or AR application. The controller 340 instructs the data driver 330 to write data to the LC panel 310 to control an amount of light from the BLU 320 to the exit pupil 250 through the LC material 326. The controller 340 generates the backlight control signal for turning ON or OFF the BLU 320, as described in more detail for FIGS. 4A 4E. In other embodiments, the electronic display 115 includes different, more or fewer components than shown in FIGS. 3A and 3B. For example, the electronic display 115 may include a polarizer and a light diffusing component.

GI and BI Modes for LCDs in VR Headset

The electronic display 115 in a VR headset has certain requirements such as a short duty cycle to prevent image streaking and short illumination times to reduce latency. While the electronic display 115 could be a Liquid Crystal Display (LCD), LCDs are currently one or two orders of magnitude slower than active matrix OLED displays (AMOLEDs). The switching time associated with the liquid crystal (LC), or the amount of time required for the LC to change state, may take several milliseconds (ms), making it difficult to achieve a short duty cycle with LCDs and limiting the speed of LCDs. In addition, normal mode of an LCD has the backlight unit (BLU) always turned on and do not have short illumination times. To improve LCD performance in a VR headset, a shorter duty cycle and illumination time may be achieved by using alternative operating modes for LCDs such as a global illumination (GI) mode or a black insertion (BI) mode.

In the GI mode, the backlight of a display turns on only after a frame of data is written (data scan out and charging) and all the LCs in a display have completed a change of state. An initial portion of the frame time is for the data scan out and charging to occur, a middle portion of the frame time is for the LC switching time, and a final portion of the frame time is for the BLU illumination.

Figure 4A:
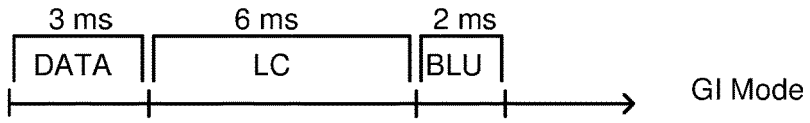
FIG. 4A is a diagram illustrating a frame cycle of an LCD in global illumination mode in accordance with an embodiment.

FIG. 4A shows an example frame time for a 90 Hz LCD in GI mode according to one embodiment. During a frame time of 11 ms, the data scan out and charging may take an initial 3 ms of the frame time, the LC material may take the next 6 ms of the frame time to transition, and the illumination of the BLU may take the last 2 ms of the frame time.

In BI mode, the data scan out and charging for a frame of data may be written during the entire frame time and the backlight of a display is turned on only during a final portion of each frame cycle. In this mode, the BLU may turn on during the data scan out and charging or during the LC switching time for some pixels of the LCD. The resulting image that is shown during the illumination portion of the BLU may include compromised pixels which have not completed the LC transition to the state indicated by the written data, and old pixels from a previous frame which are being updated during the illumination portion of the BLU.

Figure 4B:
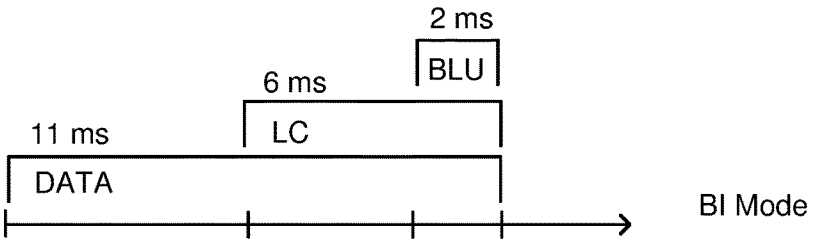
FIG. 4B is a diagram illustrating a frame cycle of an LCD in black insertion mode in accordance with an embodiment.

FIG. 4B shows an example frame time for a 90 Hz LCD in BI mode according to one embodiment. During a frame time of 11 ms, the data scan out and charging may take the full frame time of 11 ms. The illumination of the BLU may turn on during the last 2 ms of the frame time (e.g., approximately 20% of the frame time). During the illumination portion of the BLU, pixels updated during the first 3 ms of the frame time displays data that is updated and correct; pixels updated during the next 3 ms to 9 ms of the frame time may be in a compromised state, and pixels updated during the last 2 ms of the frame time may display old images from a previous frame. In a LCD running with BI mode where the pixels are updated from a top row to a bottom row, the bottom rows of the LCD may display compromised or old image data.

Embodiments of GI mode and BI mode are further described in U.S. Provisional Patent Application No. 62/326,286 filed on Apr. 22, 2016 and U.S. Provisional Patent Application No. 62/325,920, filed on Apr. 21, 2016, which are hereby incorporated by reference herein in their entirety.

Multiple Driver ICs for GI or BI Mode LCD

An LCD in a VR headset in GI or BI mode can benefit from multiple data driver integrated circuits (DIC) to read data voltages in the pixels. In a typical LCD, there is a single DIC to write data to pixels of the LCD. Having multiple DICs to write pixel data simultaneously to different pixels of a display may increase the time a single DIC has to write data to pixels of the LCD within a frame and increase the speed of the LCD. For an LCD with a single DIC, the DIC may have a predetermined amount of time to write a frame of data. With multiple DICs (n number of DICs) a single DIC has the same predetermined amount of time to write less data (1/n of a frame of data) or a single DIC may complete writing the data in a shorter amount of time (1/n of a predetermined amount of time) to allow the LCD to run at faster speeds.

Figure 4C:
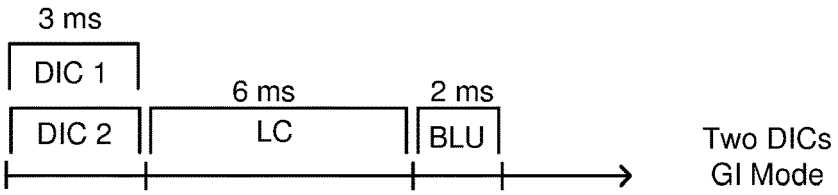
FIG. 4C is a diagram illustrating a frame cycle of an LCD using two data driver ICs in global illumination mode in accordance with an embodiment.

FIG. 4C is a diagram illustrating a frame cycle 90 Hz LCD using two data driver ICs in global illumination mode in accordance with an embodiment. During a frame time of 11 ms, the first and second DICs (DIC1 and DIC2) take an initial 3 ms of the frame time for data scan out and charging, the LC material may take the next 6 ms of the frame time to transition, and the illumination of the BLU may take the last 2 ms of the frame time. In this embodiment, DIC1 has 3 ms for data scan out and charging of one half frame of data, and DIC 2 has 3 ms for data scan out and charging of the other half frame of data. In comparison, a single DIC has 3 ms for data scan out and charging of an entire frame of data in the baseline GI mode LCD embodiment of FIG. 3A.

Figure 4D:
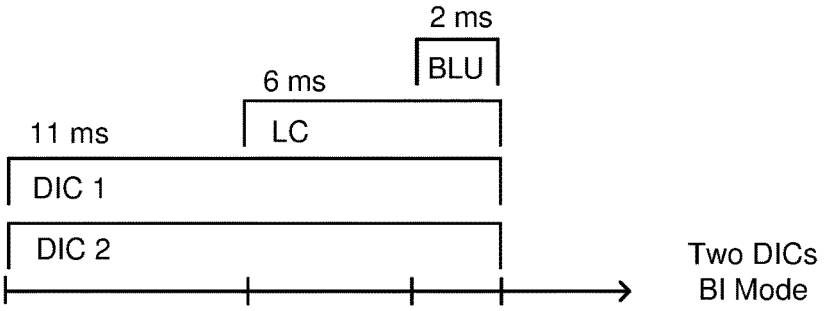
FIG. 4D is a diagram illustrating a frame cycle of an LCD using two data driver ICs in black insertion mode in accordance with an embodiment.

FIG. 4D is a diagram illustrating a frame cycle of a 90 Hz LCD using two driver ICs in black insertion mode in accordance with an embodiment. During a frame time of 11 ms, the first and second DICs (DIC 1 and DIC 2) take the entire frame time of 11 ms for data scan out and charging and the illumination of the BLU may take the last 2 ms of the frame time. In this embodiment, DIC 1 has 11 ms for data scan out and charging of one half frame of data and DIC 2 has 11 ms for data scan out and charging of the other half frame of data. In comparison, a single DIC has 11 ms for data scan out and charging of an entire frame of data in the baseline BI mode LCD embodiment of FIG. 3B.

Multiple Driver ICs for Hybrid Mode LCD

The LCD could also operate in a hybrid mode (combination of GI and BI modes) in which an initial portion of the frame time is for data scan out and charging, the remaining portion of the frame time is for the LC material to transition, and a part of the remaining portion is used for the illumination of the BLU. In the hybrid mode, a portion of frame time for the data scan out and charging is smaller than the portion of time set for a BI mode, but larger than the portion of time set for a GI mode. The remaining amount of frame time may be for the LC switching time, and the BLU turns on during a final portion of the frame time. Similar to the GI mode, the BLU does not turn on during the data scan out and charging period of the time frame. However, unlike the GI mode, the BLU may turn on during the LC switching time for some pixels of the LCD. The resulting image is similar to the BI mode in that the image shown during the illumination of the BLU may include compromised pixels which have not completed the LC transition to the state indicated by the written data. However, unlike the BI mode, old images from a previous frame would not show up during the illumination of the BLU since all pixels were updated during the initial data scan out and charging period.

Figure 4E:
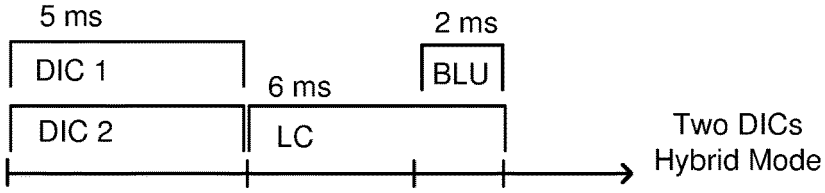
FIG. 4E is a diagram illustrating a frame cycle of an LCD using two data driver ICs in hybrid mode in accordance with an embodiment.

FIG. 4E is a diagram illustrating a frame cycle of a 90 Hz LCD using two data driver ICs in hybrid mode in accordance with an embodiment. During a frame time of 11 ms, the first and second DICs (DIC 1 and DIC 2) take the initial 5 ms of the frame time for data scan out and charging, the remaining 6 ms of the frame time for LC material to transition, and the last 2 ms of the frame time (overlapping the LC switching time) for the illumination of the BLU. In this embodiment, DIC 1 has 5 ms for data scan out and charging for one half frame of data and DIC 2 has 5 ms for data scan out and charging of the other half frame of data. In comparison, an embodiment using a single DIC would have 5 ms to write an entire frame of data.

Scan Direction for Multiple Driver ICs

Figure 5B:
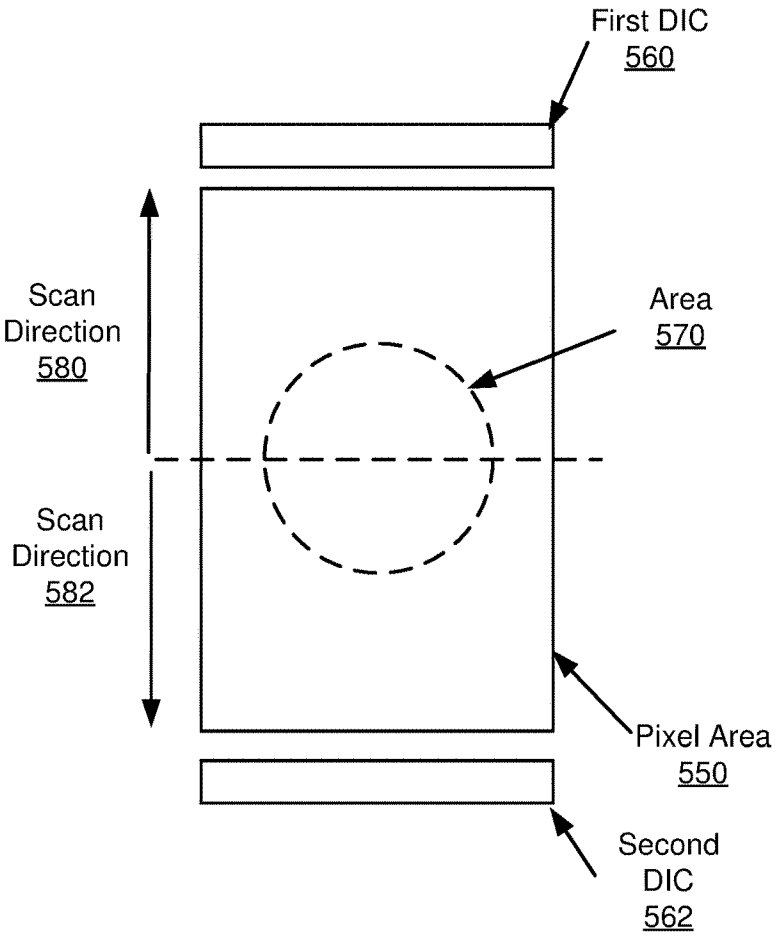
FIG. 5B is a diagram illustrating an LCD using two data driver ICs with two scan directions in accordance with an embodiment.
Figure 5A:
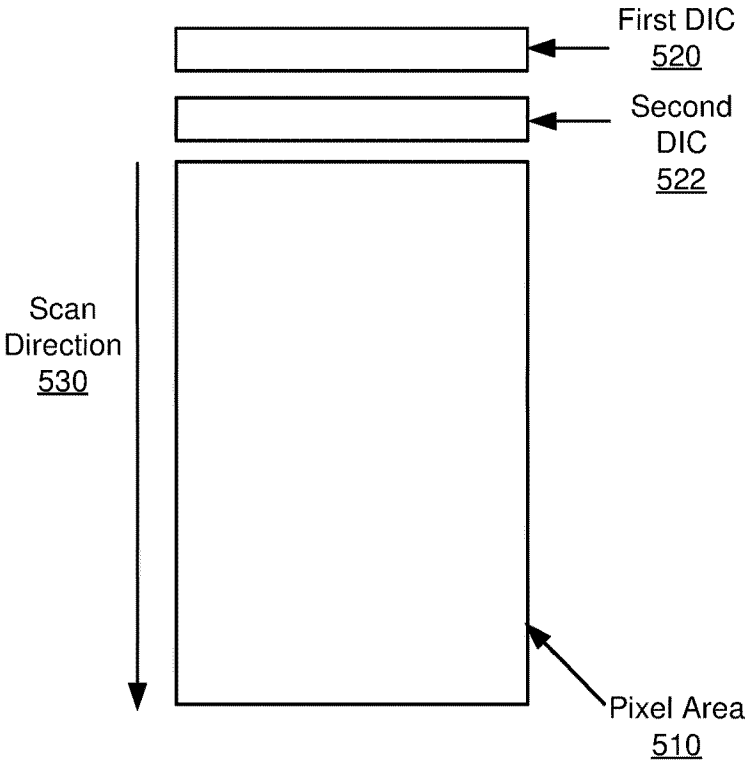
FIG. 5A is a diagram illustrating an LCD using two data driver ICs with one scan direction in accordance with an embodiment.

FIG. 5A is a diagram illustrating an LCD using two DICs with one scan direction in accordance with an embodiment. In this embodiment, the first DIC 520 and second DIC 522 are located at the top of the pixel area 510 of an LCD. Alternatively, the first DIC 520 and second DIC 522 could be located at the bottom of the pixel area 510. In one embodiment, the first DIC 520 could write data to even pixel columns and the second DIC 522 could write data to odd pixel columns of an LCD. The scan direction is indicated by arrow 430 from a top to a bottom row of the pixel area 510. In this embodiment, one scan driver could be used to scan the rows of pixels and the data lines are arranged such that the even data lines are connected to one DIC and the odd data lines are connected to another DIC.

FIG. 5B is a diagram illustrating an LCD using two data driver ICs with two scan directions in accordance with an embodiment. In this embodiment, the first DIC 560 and the second DIC 562 are on opposite sides of the pixel area 550. The first DIC 560 is located above the pixel area 550 and the second DIC 562 is located below the pixel area 550. The first DIC 560 may write data to pixels covering an upper half of the pixel area 550. The second DIC 562 may write data to pixels covering a lower half of the pixel area 550. The scan direction for the first DIC 560 may be in an upward direction, starting at a row located at or just above the middle row of the display and ending at the top row of the display, as indicated by scan direction 580. The scan direction for the second DIC 562 may be in a downward direction, starting at a row located at or just below the middle row of the display and ending at the bottom row of the display, as indicated by scan direction 582. This embodiment includes two separate scan drivers for scanning the upper and lower halves of the active area, and the data lines in the top and bottom areas are cut in half, extending only half of the active area. This embodiment may have advantages for a BI mode LCD or hybrid mode LCD. In BI mode, the last pixels to be written may be compromised or contain data from old pixels. In this case, according to scan direction 580 and 582, the last pixels to be updated would be at the top or bottom of the display. It is likely that the eye of a user is focused for the most part at the central area 570 of the display. While using such an embodiment for BI mode LCD, the pixels containing compromised or old pixel data will be in the top and bottom rows and not in the center area 570 of the LCD. While using such an embodiment for hybrid mode LCD, the pixels containing compromised data will be in the top and bottom rows and not in the center area 570 of the LCD.

Although FIGS. 4C-4E and 5A-5B illustrate embodiments having only two DICs, other embodiments may include multiple DICs such as three or four DICs. FIGS. 5A-5B show placement of DICs as being at the top and bottom locations bordering the pixel area of a display. However, DICs may be placed in other configurations, such as the right and left sides of the pixel area.

Additional Configuration Information

The foregoing description of the embodiments has been presented for the purpose of illustration; it is not intended to be exhaustive or to limit the patent rights to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A display device comprising:

a liquid crystal (LC) panel including a plurality of rows of pixels in a pixel area including a first row and a last row;

a back light unit (BLU) configured to emit light, the BLU emitting light during an illumination portion of a frame period and not emitting light during a remaining portion of the frame period;

a first data driver configured to write data to a first portion of the pixels of the LC panel; and a second data driver configured to write data to a second portion of the pixels of the LC panel, wherein the first and second data drivers write data at an overlapping time during a write portion of the frame period, the write portion overlapping in time with the remaining portion of the frame period during which the BLU does not emit light, wherein liquid crystal material in one or more rows of the pixels transitions during the illumination portion of the frame period at an end of the frame period.

2. The display device of claim 1, wherein the write portion occurs during an entire frame period.

3. The display device of claim 1, wherein the liquid crystal material in the last row of the pixels completes transition after an end of the write portion of the frame period and before an end of the frame period.

4. The display device of claim 3, wherein the liquid crystal material in the first row of the pixels completes transition after the end of the write portion of the frame period and before the end of the frame period.

5. The display device of claim 4, wherein the frame period is 11 milliseconds, the write period is 5 milliseconds, and the illumination period is 2 milliseconds.

6. The display device of claim 1, wherein the first data driver and the second data driver are located on a same side of the pixel area.

7. The display device of claim 1, wherein the first and the second data driver write data to the LC panel from the first row to the last row of the pixels.

8. The display device of claim 7, wherein the LC panel includes a plurality of columns of the pixels and the first portion of the pixels are in a first half of the columns and the second portion of the pixels are in a second half of the columns.

9. The display device of claim 8, wherein the first half of the columns are even columns and the second half of the pixel columns are odd columns.

10. The display device of claim 1, wherein the first data driver and the second data driver are located on opposite sides of the pixel area.

11. The display device of claim 1, wherein the first portion of the pixels include a top half of rows of the pixels in a top half of the pixel area and the second portion of the pixels include a bottom half of rows of the pixels in a bottom half of the pixel area.

12. The display device of claim 11, wherein the first data driver writes data from a bottom row of the top half of the rows to the first row of the LC panel and the second data driver writes data from a top row of the bottom half of the rows to the last row of the LC panel.

13. A method of displaying an image by a liquid crystal display device, the method comprising:

emitting, by a back light unit (BLU), light during an illumination portion of a frame period and not emitting light during a remaining portion of the frame period;

writing, by a first data driver, data to a first portion of pixels of a liquid crystal (LC) panel;

writing, by a second data driver, data to a second portion of the pixels of the LC panel, wherein the first and second data drivers write data at an overlapping time during a write portion of the frame period, the write portion of the frame period overlapping in time with the remaining portion of the frame period during which the BLU does not emit light, wherein liquid crystal material in one or more rows of the pixels transitions during the illumination portion of the frame period at an end of the frame period.

14. The method of claim 13, wherein:

the first data driver and the second data driver are located on opposite sides of a pixel area on the LC panel, the LC panel includes a plurality of rows of the pixels including a first row and a last row of the pixels;

the first portion of the pixels include a top half of rows of the pixels in a top half of the pixel area and the second portion of the pixels include a bottom half of rows of the pixels in a bottom half of the pixel area, the first data driver writes data from a bottom row of the top half of the rows to the first row of the LC panel, and the second data driver writes data from a top row of the bottom half of the rows to the last row of the LC panel.

15. The method of claim 13, wherein:

the first data driver and the second data driver are located on a same side of a pixel area of the LC panel, the first and the second data driver write data to the LC panel from a first row to a last row of the pixels, the LC panel includes a plurality of columns of the pixels and the first portion of the pixels are in a first half of the columns and the second portion of the pixels are in a second half of the columns, and the first half of the columns are even columns and the second half of the pixel columns are odd columns.

* * * * *